US007918691B2

(12) United States Patent
Assel et al.

(10) Patent No.: US 7,918,691 B2
(45) Date of Patent: Apr. 5, 2011

(54) METHOD AND DEVICE FOR ELECTRICALLY CONNECTING A FUNCTIONAL ELEMENT CONTAINED IN A HOUSING

(75) Inventors: Martin Assel, Burgbernheim (DE); Michael Traeger, Heilsbronn (DE)

(73) Assignee: Oechsler Aktiengesellschaft, Ansbach (DE)

( * ) Notice: Subject to any disclaimer, the term of this patent is extended or adjusted under 35 U.S.C. 154(b) by 0 days.

(21) Appl. No.: 12/445,347

(22) PCT Filed: Oct. 4, 2007

(86) PCT No.: PCT/EP2007/008586

§ 371 (c)(1),
(2), (4) Date: Nov. 9, 2009

(87) PCT Pub. No.: WO2008/046516

PCT Pub. Date: Apr. 24, 2008

(65) Prior Publication Data

US 2010/0093224 A1 Apr. 15, 2010

(30) Foreign Application Priority Data

Oct. 13, 2006 (DE) ..... 10 2006 048 843

(51) Int. Cl.
*H01R 33/00* (2006.01)

(52) U.S. Cl. ..... 439/660

(58) Field of Classification Search ..... 439/541.5, 439/660, 676, 79, 924.1, 492
See application file for complete search history.

(56) References Cited

U.S. PATENT DOCUMENTS

| | | | | |
|---|---|---|---|---|
| 7,097,497 | B2 * | 8/2006 | Kikuchi | 439/541.5 |
| 7,261,579 | B2 * | 8/2007 | Ku et al. | 439/289 |
| 2003/0060087 | A1 * | 3/2003 | Yi-Tse | 439/660 |
| 2004/0127104 | A1 * | 7/2004 | Stefaniu et al. | 439/660 |
| 2008/0293534 | A1 | 11/2008 | Dettenberger et al. | |

FOREIGN PATENT DOCUMENTS

| | | |
|---|---|---|
| DE | 10 2005 021 767 A1 | 9/2006 |
| EP | 1 503 480 B1 | 2/2005 |

OTHER PUBLICATIONS

Form PCT/ISA/210 (International Search Report) dated Jan. 22, 2008.
Form PCT/ISA/237 (Written Opinion of the International Searching Authority).
Form PCT/IPEA/409 (International Preliminary Report on Patentability).
English language version of the International Preliminary Report on Patentability of Application No. PCT/EP2007/008586.

* cited by examiner

*Primary Examiner* — Jean F Duverne
(74) *Attorney, Agent, or Firm* — Buchanan Ingersoll & Rooney PC

(57) ABSTRACT

In spite of the absence of a pullout fuse block, functional elements comprising simple socket-type connectors come into contact with an external cable in a mechanically and electrically reliable manner, when said cable has a rod-type or sword-type mating connector which engages directly in the connector by means of a radially protruding return baffle, in a sealed manner, through the rear of an opening in the wall of a housing. If, during the plug-in action, an injection-molded skin which first at least partially closes the opening is enlarged or perforated, the breaking edge nestling against the envelope surface of the mating connector in the plug-in direction provides another retraction block with additional sealing and vibration damping.

6 Claims, 1 Drawing Sheet

Figure 1:
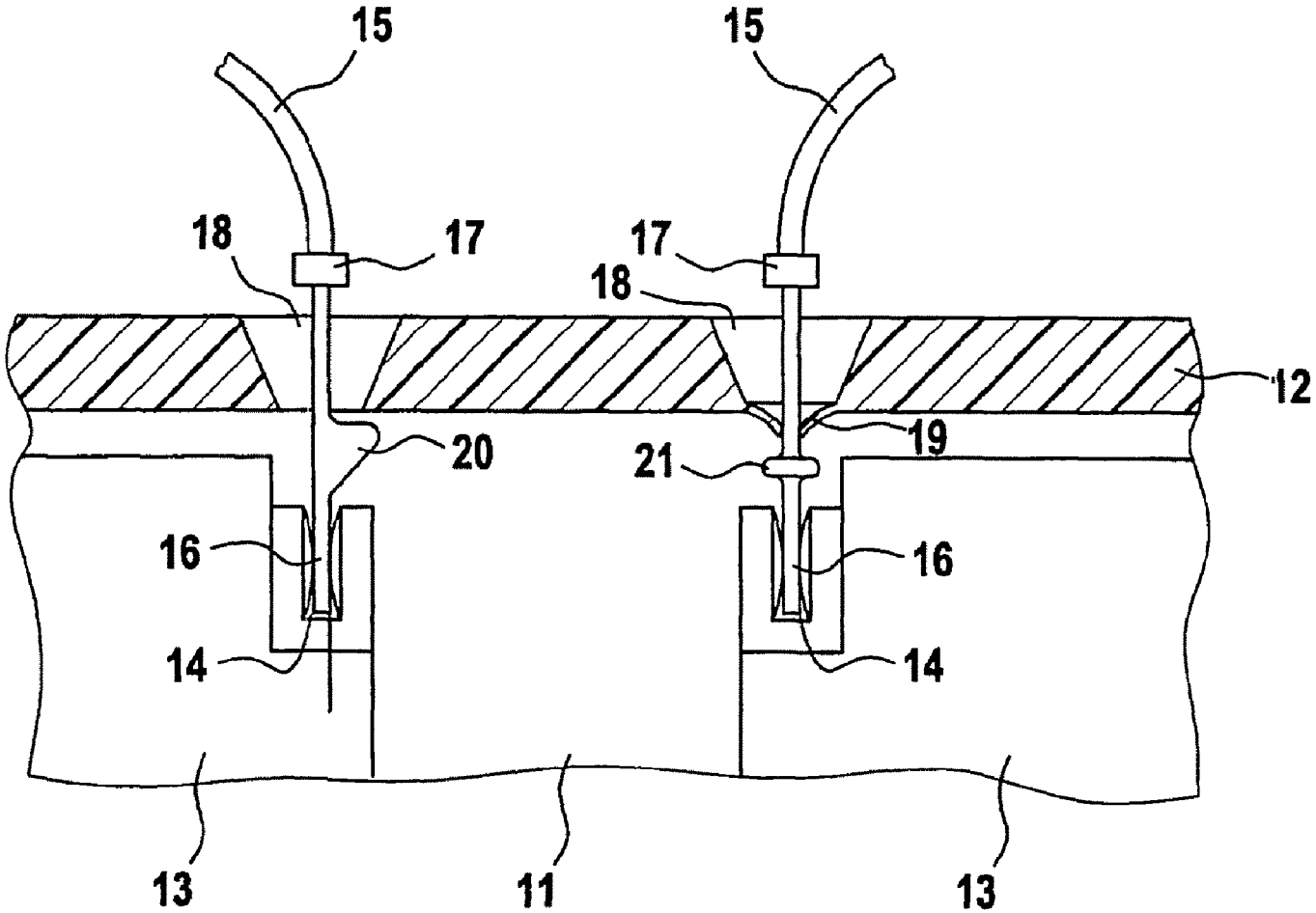

METHOD AND DEVICE FOR ELECTRICALLY CONNECTING A FUNCTIONAL ELEMENT CONTAINED IN A HOUSING

The invention relates to a device according to the preamble of the main claim.

A device of this type is known from EP 1 503 480 A1 as an apparatus for accommodating a motor vehicle blower motor in a housing, the wall of said housing being provided with a hollow-cylindrical passage opening for connecting a cable-connectorized plug to the motor. According to the prior art referred to in that document, the plug engages behind the passage opening within the housing wall by means of a latching arrangement in the form of lugs which spread out in the manner of the barbs behind the passage opening when a tensile load is applied to the cable. However, a structure of this type is rejected as being unfavorable and instead the position of the latching system is laid outside the housing, where it engages behind a lug which is to be formed so as protrude from said housing on said housing in a dedicated manner for this. The inlet opening situated behind this in the housing itself is surrounded by an elastic sealing bead. Such structural separation of retaining and sealing functions in principle increases the installation dimensions, in any case can be less mechanically loaded than in the case of engaging behind the housing wall itself, and complicates the plugging process as it has to be conducted through two round holes which are spaced apart one behind the other.

Within the scope of the present invention, the electrical functional element is typically a sensor (for example an opto-electronic pulse sensor) or an actuator (for example an electromotive actuating element), in particular for use in a motor vehicle. A functional element of this type (for example a motor for operating the parking brake of a motor vehicle according to DE 10 2005 021 767 A1) is routinely surrounded by a housing which accordingly does not accommodate only the motor, especially when it is a constituent part of a functional group, for simplifying assembly and for protecting against environmental influences, said housing, for its part first and in the fully fitted state, being mounted in its working environment. The functional element is typically equipped with plugs for receiving the mating plugs of a connectorized multicore cable in the interior of the housing, which cable leads to a connector strip on the periphery of the housing. An external cable is connected there by means of a plug, said external cable then leading directly or via a bus interface, for example, to a processor for processing sensor data or for controlling an actuator.

The invention is based on the technical problem of developing a space-saving, easy-to-handle and reliably sealing connection of an external plug to a functional element in the interior of a housing.

According to the invention, this object is achieved by the essential features specified in the main claim. According to said main claim, a passage opening which tapers toward the interior of the housing is provided as an insertion aid in the wall of the housing through which the plug passes.

Provision may be made, in particular, to not insert the plug through a passage opening which already traverses the wall but to widen or initially break open the passage opening during the plugging process to the geometry required for this at a predetermined breaking point which can be identified as such and initially also is at least partially closed—for example by a barrier which covers the smaller base of the hollow truncated cone-like passage opening, for example in the form of an injection-molded skin. This has the advantage that the geometry of the passage opening actually used matches in an optimally sealing manner the cross-sectional geometry of the mating plug which is given in the individual case. The edges of the passage opening created in this way, that is to say of the injection-molded skin for example, then fit closely against the outer casing surface of the sword- or pin-like mating plug in the insertion direction and as a result provide good vibration damping in addition to even more effective sealing, as a result of which the plug connection on the functional element is mechanically relieved of strain, that is to say is additionally secured.

The functional element which is equipped with a simple sheath- or socket-like plug is usually placed in the vicinity of the wall of the housing, which is produced by plastic injection-molding for example, in such a way that the sword- or pin-like (mating) plug of the external cable, which (mating) plug is inserted through the housing, engages directly in the associated (appliance) plug on the functional element in the interior of the housing. With regard to its insertion direction, this internal plug is oriented substantially orthogonal to the cross section of the housing wall passage opening for the external plug. As is known as such from the prior art which forms this generic type, a free space is produced between the internal plug and the inner face of the housing in the vicinity of its passage opening for the external plug.

So that the plug connection is not released again when a mechanical tensile load is applied to the cable of the external mating plug which passes through the wall of the housing, which can have serious operational consequences, the mating plug is equipped with a rigid or in any case not easily deformable baffle, for example in the form of a bead, a lug or a circumferential annular flange, which, after penetrating the housing wall, comes to rest in the free space upstream of the plug, that is to say downstream of the passage opening. This baffle has a cross section which is at most so slightly larger than the smallest diameter of the passage opening in the wall of the housing through which the mating plug passes that said baffle can be forced through the passage opening during the course of the plugging process even with reversible deformation of the baffle and/or the passage opening.

The baffle not only virtually prevents or at least wholly essentially makes it more difficult for the mating plug to slip out of the housing, and therefore out of the plug on the functional element, due to the cable being pulled or due to vibrations, that is to say mechanically secures this direct plug connection of the external cable to the functional element without the functional element having to have its own more costly appliance plug with pull-out securing means for this purpose; primarily, the thickening of the baffle leads, on account of bearing against that edge of the passage opening which is laid in the direction of the housing interior, to reliable sealing against, for example, corrosive environmental influences as soon as the external mating plug has shifted backward slightly as a result of the cable being pulled or due to vibrational influences, while maintaining its plugged position.

Supplementary developments and alternatives can be found in the further claims and, with regard to the advantages of these developments and alternatives, from the following description of a preferred implementation example of the solution according to the invention which is not drawn to scale in the drawing but in a manner abstracted to what is functionally essential. The single FIGURE of the drawing shows a broken-away cross section of two variants of mechanical securing baffles on plug connectors which engage directly into the functional element through a housing wall.

The invention claimed is:

1. A device, which has a plug connection which passes through a housing and comprises a plug and a mating plug, for electrically connecting a functional element which is installed in the housing and is equipped with the plug in which the mating plug of an external cable which is connectorized with said mating plug engages directly through a passage opening in the wall of the housing, wherein a passage opening is provided in the wall for passage of the mating plug which is equipped with a retractable baffle, said passage opening widening outward in a manner oriented out of the housing, wherein the passage opening is covered by a pre-perforated or closed sealing skin, which is to be broken open, in the direction of the interior of the housing, by the mating plug when the mating plug is inserted through the housing directly into the plug.

2. The device as claimed in claim 1, wherein the sealing skin is an injection-molded skin.

3. The device as claimed in claim 1, wherein the passage opening is a hollow truncated cone-like passage having a relatively small end and a relatively large end.

4. The device as claimed in claim 3, wherein the sealing skin covers the relatively small end of the hollow truncated cone-like passage.

5. The device as claimed claim 1, wherein the baffle is lug-like or ring-like and is positioned in a free space between the plug and the passage opening.

6. The device as claimed in claim 5, wherein the baffle rests in a sealing manner against the wall, downstream of the passage opening.

* * * * *